US005933805A

United States Patent [19]

Boss et al.

[11] Patent Number: 5,933,805

[45] Date of Patent: Aug. 3, 1999

[54] RETAINING PROSODY DURING SPEECH ANALYSIS FOR LATER PLAYBACK

[75] Inventors: Dale Boss, Portland; Sridhar Iyengar; T. Don Dennis, both of Beaverton, all of Oreg.

[73] Assignee: Intel Corporation, Santa Clara, Calif.

[21] Appl. No.: 08/764,961

[22] Filed: Dec. 13, 1996

[51] Int. Cl.[6] ..... G10L 5/00

[52] U.S. Cl. ..... 704/249; 704/258; 704/207; 704/223; 704/209

[58] Field of Search ..... 704/249, 257, 704/207, 258, 201, 223, 209

[56] References Cited

U.S. PATENT DOCUMENTS

| | | | |
|---|---|---|---|
| 3,936,595 | 2/1976 | Yanagimachi et al. | 358/341 |
| 4,241,329 | 12/1980 | Bahler et al. | 704/231 |
| 4,797,930 | 1/1989 | Goudie et al. | 704/201 |
| 4,799,261 | 1/1989 | Lin et al. | 704/201 |
| 4,802,221 | 1/1989 | Jibbe | 381/34 |
| 4,802,223 | 1/1989 | Lin et al. | 704/201 |
| 5,130,815 | 7/1992 | Silverman et al. | 358/341 |
| 5,230,037 | 7/1993 | Giustiniani et al. | 704/256 |
| 5,289,288 | 2/1994 | Silverman et al. | 358/341 |
| 5,465,290 | 11/1995 | Hampton et al. | 379/67 |
| 5,592,585 | 1/1997 | Van Coile et al. | 704/206 |
| 5,615,300 | 3/1997 | Hara et al. | 704/260 |
| 5,617,507 | 4/1997 | Lee et al. | 704/200 |

OTHER PUBLICATIONS

Henphill "surfing the web by voice"T.I., 1996.

Steve Smith, "Dual Joy Stick Speaking Word Processor and Musical Instrument," Proceedings: John Hopkins National Search for Computing Applications to Assist Persons with Disabilities, Feb. 1–5, 1992, p. 177.

B. Abner & T. Cleaver, "Speech Synthesis Using Frequency Modulation Techniques," Proceedings: IEEE Southeastcon '87, Apr. 5–8, 1987, vol. 1 of 2, pp. 282–285.

Alex Waibel, "Prosodic Knowledge Sources for Word Hypothesization in a Continuous Speech Recognition System," IEEE, 1987, pp. 534–537.

Alex Waibel, "Research Notes in Artificial Intelligence, Prosody and Speech Recognition," 1988, pp. 1–213.

Victor W. Zue, "The Use of Speech Knowledge in Automatic Speech Recognition," IEEE, 1985, pp. 200–213.

*Primary Examiner*—David R. Hudspeth
*Assistant Examiner*—Daniel Abebe
*Attorney, Agent, or Firm*—Kenyon & Kenyon

[57] ABSTRACT

A speech system includes a speech encoding system and a speech decoding system. The speech encoding system includes a speech analyzer for identifying each of the speech segments (i.e., phonemes) in the received digitized speech signal. A pitch detector, a duration detector, and an amplitude detector are each coupled to the memory and the analyzer and detect various prosodic parameters of each received speech segment. A speech encoder generates a data signal that includes the speech segment IDs and the values of the corresponding prosodic parameters. The speech decoding system includes a digital data decoder and a speech synthesizer for generating a speech signal based on the segment IDs and prosodic parameter values.

10 Claims, 5 Drawing Sheets

RETAINING PROSODY DURING SPEECH ANALYSIS FOR LATER PLAYBACK

CROSS REFERENCE TO RELATED APPLICATIONS

The subject matter of the present application is related to the subject matter of U.S. patent application attorney docket number 2207/4031, entitled "Representing Speech Using MIDI," to Dale Boss, Sridhar Iyengar and T. Don Dennis and assigned to Intel Corporation, filed on even date herewith, and U.S. patent application attorney docket number 2207/4069, entitled "Audio Fonts Used For Capture and Rendering," to Timothy Towell and assigned to Intel Corporation, filed on even date herewith.

BACKGROUND

The present invention relates to speech systems and more particularly to a system for encoding speech signals into a compact representation that includes speech segments and prosodic parameters that permits accurate and natural sounding playback.

Speech analysis systems include speech recognition systems and speech synthesis systems. Automatic speech recognition systems, also known as speech-to-text systems, include a computer (hardware and software) that analyzes a speech signal and produces a textual representation of the speech signal. FIG. 1 illustrates a functional block diagram of a prior art automatic speech recognition system. An automatic speech recognition system can include an analog-to-digital (A/D) converter 10 for digitizing the analog speech signal, a speech analyzer 12 and a language analyzer 14. Initially, the system stores a dictionary including a pattern (i.e., digitized waveform) and textual representation for each of a plurality of speech segments (i.e., vocabulary). These speech segments may include words, syllables, diphones, etc. The speech analyzer divides the speech into a plurality of segments, and compares the patterns of each input segment to the segment patterns in the known vocabulary using pattern recognition or pattern matching in attempt to identify each segment.

Language analyzer 14 uses a language model, which is a set of principles describing language use, to construct a textual representation of the received speech segments. In other words, the speech recognition system uses a combination of pattern recognition and sophisticated guessing based on some linguistic and contextual knowledge. For example, certain word sequences are much more likely to occur than others. The language analyzer may work with the speech analyzer to identify words or resolve ambiguities between different words or word spellings. However, due to a limited vocabulary and other system limitations, a speech recognition system can guess incorrectly. For example, a speech recognition system receiving a speech signal having an unfamiliar accent or unfamiliar words may incorrectly guess several words, resulting in a textual output which can be unintelligible.

One proposed speech recognition system is disclosed in Alex Waibel, "Prosody and Speech Recognition, Research Notes In Artificial Intelligence," Morgan Kaufman Publishers, 1988 (ISBN 0-934613-70-2).

Waibel discloses a speech-to-text system (such as an automatic dictation machine) that extracts prosodic information or parameters from the speech signal to improve the accuracy of text generation. Prosodic parameters associated with each speech segment may include, for example, the pitch (fundamental frequency $F_0$) of the segment, duration of the segment, and amplitude (or stress or volume) of the segment. Waibel's speech recognition system is limited to the generation of an accurate textual representation of the speech signal. After generating the textual representation of the speech signal, any prosodic information that was extracted from the speech signal is discarded. Therefore, a person or system receiving the textual representation output by a speech-to-text system will know what was said, but will not know how it was said (i.e., pitch, duration, rhythm, intonation, stress).

Similarly, as illustrated in FIG. 2, speech synthesis systems exist for converting text to synthesized speech, and can include, for example, a language synthesizer 16, a speech synthesizer 18 and a digital-to-analog (D/A) converter 20. Speech synthesizers use a plurality of stored speech segments and their associated representation (i.e., vocabulary) to generate speech by, for example, concatenating the stored speech segments. However, because no information is provided with the text as to how the speech should be generated (i.e., pitch, duration, rhythm, intonation, stress), the result is typically an unnatural or robot sounding speech. As a result, automatic speech recognition (speech-to-text) systems and speech synthesis (text-to-speech) systems may not be effectively used for the encoding, storing and transmission of natural sounding speech signals. Moreover, the areas of speech recognition and speech synthesis are separate disciplines. Speech recognition systems and speech synthesis systems are not typically used together to provide for a complete system that includes both encoding an analog signal into a digital representation and then decoding the digital representation to reconstruct the speech signal. Rather, speech recognition systems and speech synthesis are employed independently of one another, and therefore, do not typically share the same vocabulary and language model.

A functional block diagram of a prior art system which may be used for encoding, storage and transmission of audio signals is illustrated in FIG. 3. An audio signal, which may include a speech signal, is digitized by an A/D converter 22. A compressor/decompressor (codec) 24 compresses the digitized audio signal by, for example, removing superfluous or unnecessary information. The digitized audio may be transmitted over a transmission medium 26. At the receiving end, the signal is decompressed by a codec 28 and converted to an analog signal by a D/A converter 30 for output to a speaker 32. Even though the system of FIG. 3 can provide excellent speech rendering, this technique requires a relatively high bit rate (bandwidth) for transmission and a very large storage capacity for storing the digitized speech information, and provides no flexibility.

Therefore, a need has arisen for a speech system that provides a compact representation of a speech signal for efficient transmission, storage, etc., and which permits accurate (i.e., what was said) and natural sounding (i.e., how it was said) reconstruction of the speech signal.

SUMMARY OF THE INVENTION

The present invention overcomes disadvantages and drawbacks of prior art speech systems.

An embodiment of a speech encoding system of the present invention includes a memory for storing a speech dictionary. The dictionary includes a pattern and a corresponding identification (ID) for each of a plurality of speech segments (i.e., phonemes). The speech encoding system also includes an A/D converter for digitizing an analog speech signal. A speech analyzer is coupled to the memory and receives the digitized speech signal from the A/D converter. The speech analyzer identifies each of the speech segments in the received digitized speech signal based on the dictionary. The speech analyzer outputs each of the digitized speech segments and the segment ID for each of the identified speech segments. The speech encoding system also includes one or more prosodic parameter detectors, such as a pitch detector, a duration detector, and an amplitude detector coupled to the memory and the analyzer. The prosodic parameter detectors detect various prosodic parameters of each digitized segment, and output prosodic parameter values indicating the values of the detected parameters. The speech encoding system also includes a digital data encoder coupled to the prosodic parameter detectors and the speech analyzer. The digital data encoder generates a digital data stream for transmission or storage, or other use. The digital data stream includes a speech segment ID and the corresponding prosodic parameter values for each of the digitized speech segments of the received speech signal.

An embodiment of a speech decoding system of the present invention includes a memory storing a dictionary comprising a digitized pattern and a corresponding segment ID for each of a plurality of speech segments (i.e., phonemes). The speech decoding system also includes a digital data decoder coupled to the memory and receiving a digital data stream from a transmission medium. The decoder identifies and outputs speech segment IDs and the corresponding prosodic parameter values (i.e., 1 KHz for pitch, 0.35 ms for duration, 3.2 volts peak-to-peak for amplitude) in the received data stream. A speech synthesizer is coupled to the memory and the decoder. The synthesizer selects digitized patterns in the dictionary corresponding to the segment IDs received from the decoder and modifies each of the selected digitized patterns according to the corresponding prosodic parameter values received from the decoder. The speech synthesizer then outputs the modified speech patterns to generate a speech signal.

DETAILED DESCRIPTION

Figure 1:
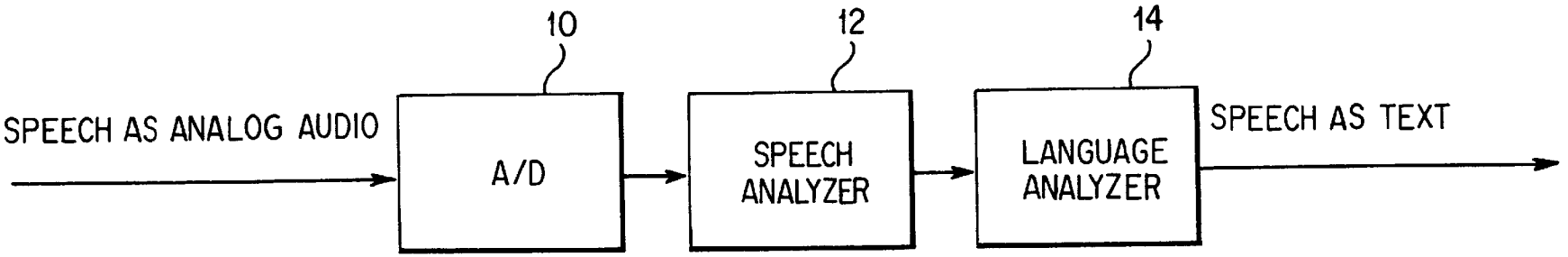
FIG. 1 PRIOR ART
FIG. 1 illustrates a functional block diagram of a prior art automatic speech recognition system.
Figure 2:
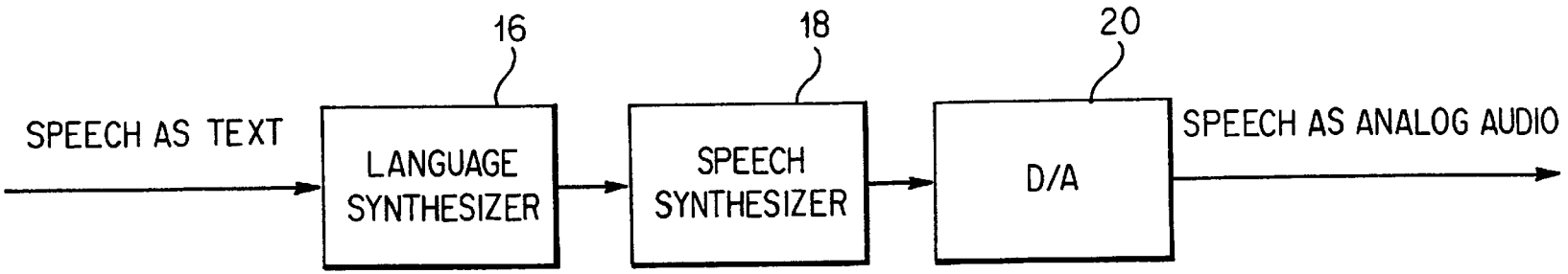
FIG. 2 PRIOR ART
FIG. 2 illustrates a functional block diagram of a prior art speech synthesis system.
Figure 3:
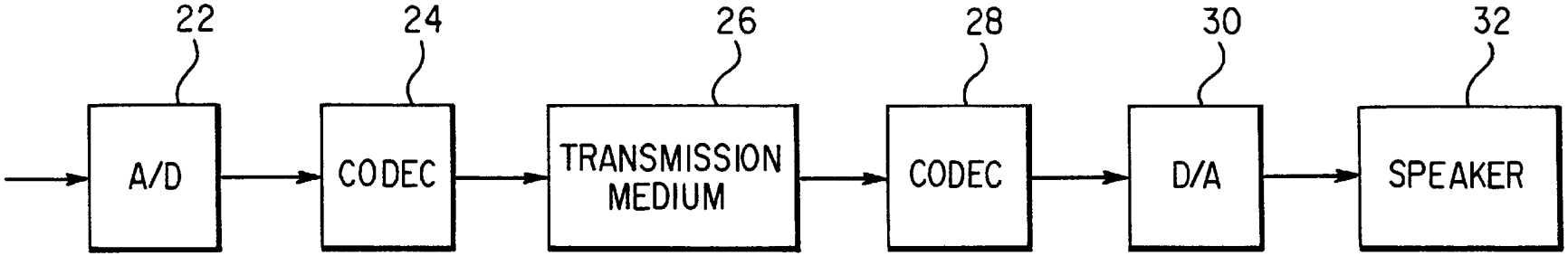
FIG. 3 PRIOR ART
FIG. 3 illustrates a functional block diagram of a prior art system which may be used for encoding, storage and transmission of audio signals.
Figure 4:
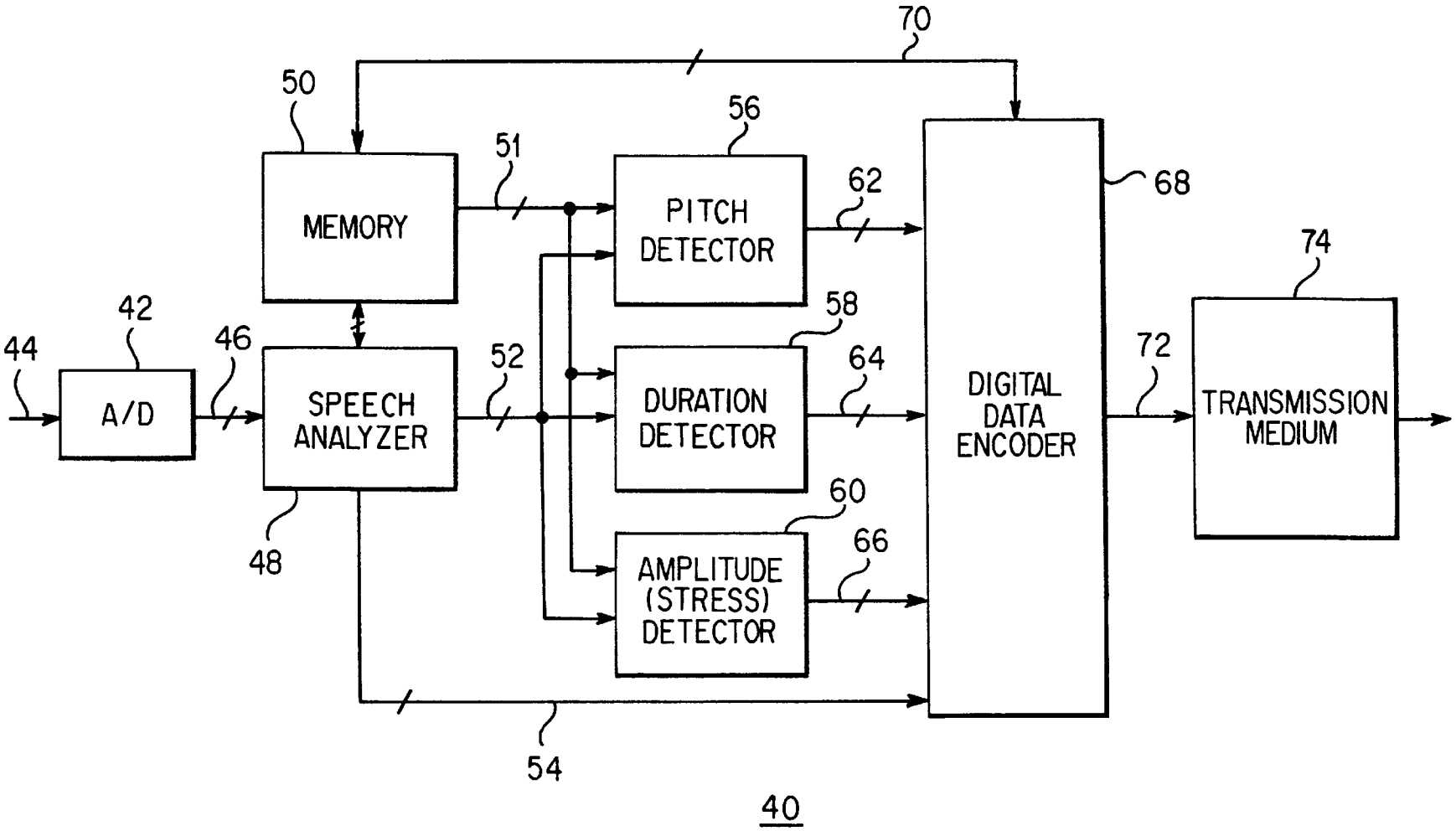
FIG. 4 illustrates a functional block diagram of a speech encoding system according to an embodiment of the present invention.

FIG. 4 illustrates a speech encoding system according to an embodiment of the present invention. Speech encoding system 40 includes an A/D converter 42 for digitizing an analog speech signal received on line 44. Encoding system 40 also includes a memory 50 for storing a speech dictionary, comprising a digitized pattern and a corresponding phoneme identification (ID) for each of a plurality of phonemes. A speech analyzer 48 is coupled to A/D converter 42 and memory 50 and identifies the phonemes of the digitized speech signal received over line 46 based on the stored dictionary. A plurality of prosodic parameter detectors, including a pitch detector 56, a duration detector 58, and an amplitude detector 60, are each coupled to memory 50 and speech analyzer 48 for detecting various prosodic parameters of the phonemes received over line 52 from analyzer 48, and outputting prosodic parameter values indicating the value of each detected parameter. A digital data encoder 68 is coupled to memory 50, detectors 56, 58 and 60, and analyzer 48, and generates a digital data stream including phoneme IDs and corresponding prosodic parameter values for each of the phonemes received by analyzer 48.

The speech dictionary (i.e., phoneme dictionary) stored in memory 50 comprises a digitized pattern (i.e., a phoneme pattern) and a corresponding phoneme ID for each of a plurality of phonemes. It is advantageous, although not required, for the dictionary used in the present invention to use phonemes because there are only 40 phonemes in American English, including 24 consonants and 16 vowels, according to the International Phoneme Association. Phonemes are the smallest segments of sound that can be distinguished by their contrast within words. Examples of phonemes include /b/, as in bat, /d/, as in dad, and /k/ as in key or coo. Phonemes are abstract units that form the basis for transcribing a language unambiguously. Although embodiments of the present invention are explained in terms of phonemes (i.e., phoneme patterns, phoneme dictionaries), the present invention may alternatively be implemented using other types of speech segments, such as diphones, words, syllables, etc.

The digitized phoneme patterns stored in the phoneme dictionary in memory 50 can be the actual digitized waveforms of the phonemes. Alternatively, each of the stored phoneme patterns in the dictionary may be a simplified or processed representation of the digitized phoneme waveforms, for example, by processing the digitized phoneme to remove any unnecessary information. Each of the phoneme IDs stored in the dictionary is a multi bit quantity (i.e., a byte) that uniquely identifies each phoneme.

The phoneme patterns stored for all 40 phonemes in the dictionary are together known as a voice font. A voice font can be stored in memory 50 by a person saying into a microphone a standard sentence that contains all 40 phonemes, digitizing, separating and storing the digitized phonemes as digitized phoneme patterns in memory 50. System 40 then assigns a standard phoneme ID for each phoneme pattern. The dictionary can be created or implemented with a generic or neutral voice font, a generic male voice (lower in pitch, rougher quality etc.), a generic female voice font (higher pitch, smoother quality), or any specific voice font, such as the voice of the person inputting speech to be encoded.

A plurality of voice fonts can be stored in memory 50. Each voice font contains information identifying unique voice qualities (unique pitch or frequency, frequency range, rough, harsh, throaty, smooth, nasal, etc.) that distinguish each particular voice from others. The pitch, duration and amplitude of the received digitized phonemes (patterns) of the voice font can be calculated (for example, using the method discussed below) and are assigned the average pitch, duration and amplitude for this voice font. In addition, a speech frequency (pitch) range can be estimated for this voice, for example as the speech frequency range of an average person (i.e., 3 KHz), but centered at the average frequency for each phoneme. Range estimates for duration and amplitude can similarly be used.

Also, with eight bits, for example, to represent the value of each prosodic parameter, there are 256 possible quantized values for pitch, duration and amplitude, and for example, can be spaced evenly across their respective ranges. Each of the average pitch, duration and amplitude values for each voice font are assigned, for example, the middle quantized level, number 128 out of 256 total quantized levels. For example, with 256 quantized pitch levels spread across a 3 kHz pitch range, with an average pitch for the phoneme \b\ of, for example, 11.5 kHz, the 256 quantized pitch levels would extend across the range 10–13 kHz, having spacing between each quantized level of approximately 11.7 Hz (3000 Hz/256). Any number of bits can be used to represent each prosodic parameter, and it is not necessary to center the ranges on the average value. Alternatively, each person may read several sentences into the decoding system 40, and decoding system 40 may estimate a range of each prosodic parameter based on the variation of each prosodic parameter between the sentences.

Therefore, one or more voice fonts can be stored in memory 50 including the phoneme patterns (indicating average values for each prosodic parameter). Although not required, to increase speed of the system, encoding system 40 may also calculate and store in memory 50 with the voice font the average prosodic parameter values for each phoneme including average pitch, duration and amplitude, the ranges for each prosodic parameter for this voice, the number of quantization levels, and the spacing between each quantization level for each prosodic parameter.

In order to assist system 40 in accurately encoding the speech signal received on line 44 into the correct values, memory 50 should include the voice font of the person inputting the speech signal for encoding, as discussed below. The voice font which is used by system 40 to assist in encoding speech signal 44 can be user selectable through a keyboard, pointing device, etc., or a verbal command at the beginning of the speech signal 44, and is known as the designated input voice font. Also, as discussed in greater detail below regarding FIG. 5, the person inputting the sentence to be encoded can also select a designated output voice font to be used to reconstruct and generate the speech signal.

Speech analyzer 48 receives the digitized speech signal on line 46 output by A/D converter 42 and has access to the phoneme dictionary (i.e., phoneme patterns and corresponding phoneme IDs) stored in memory 50. Speech analyzer 48 uses pattern matching or pattern recognition to match the pattern of the received digitized speech signal 46 to the plurality of phoneme patterns stored in the designated input voice font in memory 50. In this manner, speech analyzer 48 identifies all of the phonemes in the received speech signal. To identify the phonemes in the received speech signal, speech analyzer 48, for example, may break up the received speech signal into a plurality of speech segments (syllables, words, groups of words, etc.) larger than a phoneme for comparison to the stored phoneme vocabulary to identify all the phonemes in the large speech segment. This process is repeated for each of the large speech segments until all of the phonemes in the received speech signal have been identified.

After identifying each of the phonemes in the speech signal received over line 46, speech analyzer 48 separates the received digitized speech signal into the plurality of digitized phoneme patterns. The pattern for each of the received phonemes can be the digitized waveform of the phoneme, or can be a simplified representation that includes information necessary for subsequent processing of the phoneme, discussed in greater detail below.

Speech analyzer 48 outputs the pattern of each received phoneme on line 52 for further processing, and at the same time, outputs the corresponding phoneme ID on line 54. For 40 phonemes, the phoneme ID may be a 6 bit signal provided in parallel over line 54. Analyzer 48 outputs the phoneme patterns and corresponding phoneme IDs sequentially for all received phonemes (i.e., on a first-in, first-out basis). The phoneme IDs output on line 54 only indicate what was said in the speech signal input on line 44, but does not indicate how the speech was said. Prosodic parameter detectors 56, 58 and 60 are used to identify how the original speech signal was said. Also, the designated input voice font, if it was selected to be the voice font of the person inputting the speech signal, also provides information regarding the qualities of the original speech signal.

Pitch detector 56, Duration detector 58 and amplitude detector 60 measure various prosodic parameters for each phoneme. The prosodic parameters (pitch, duration and amplitude) of each phoneme indicate how the speech was said and are important to permit a natural sounding reconstruction or playback of the original speech signal.

Pitch detector 56 receives each phoneme pattern on line 52 from speech analyzer 48 and estimates the pitch (fundamental frequency $F_0$) of the phoneme represented by the received phoneme pattern by any one of several conventional time-domain techniques or by any one of the commonly employed frequency-domain techniques, such as autocorrelation, average magnitude difference, cepstrum, spectral compression and harmonic matching methods. These techniques may also be used to identify changes in the fundamental frequency of the phoneme (i.e., a rising or lowering pitch, or a pitch shift). Pitch detector 56 also receives the designated input voice font from memory 50 over line 51. With 8 bits used to indicate phoneme pitch, there are 256 distinct frequencies or quantized levels, which are spaced evenly across the frequency range and centered at the average frequency for this phoneme, as indicated by information stored in memory 50 with the designated input voice font. Therefore, there are approximately 128 frequency values above the average, and 128 frequency values below the average frequency for each phoneme. Due to the unique qualities of each voice, different voice fonts can have different average pitches (frequencies) for each phoneme, different frequency ranges, and different spacing between each quantized level in the frequency range.

Pitch detector 56 compares the pitch of the phoneme represented by the received phoneme pattern (received over line 52) to the pitch of the corresponding phoneme in the designated input voice font. Pitch detector 56 outputs an eight bit value on line 62 identifying the relative pitch of the received phoneme as compared to the average pitch for this phoneme (as indicated by the designated input voice font).

Duration detector 58 receives each phoneme pattern on line 52 from speech analyzer 48 and measures the time duration of the received phoneme represented by the received phoneme pattern. Duration detector 58 compares the duration of the phoneme to the average duration for this phoneme as indicated by the designated input voice font. With, for example, 8 bits used to indicate phoneme duration, there are 256 distinct duration values, which are spaced evenly across a range centered at the average duration for this phoneme, as indicated by the designated input voice font. Therefore, there are approximately 128 duration values above the average, and 128 duration values below the average duration for each phoneme. Duration detector 58 outputs an eight bit value on line 64 identifying the relative duration of the received phoneme as compared to the average phoneme duration indicated by the designated input voice font.

Amplitude detector 60 receives each phoneme pattern on line 52 from speech analyzer 48 and measures the amplitude of the received phoneme pattern. Amplitude detector 60 may, for example, measure the amplitude of the phoneme as the average peak-to-peak amplitude across the digitized phoneme. Other amplitude measurement techniques may be used. Amplitude detector 60 compares the amplitude of the received phoneme to the average amplitude of the phoneme as indicated by the designated input voice font received over line 51. Amplitude detector 60 outputs an eight bit value on line 66 identifying the relative amplitude of the received phoneme as compared to the average amplitude of the phoneme as indicated by the designated input voice font.

Digital data encoder 68 generates or outputs a digital data stream 72 representing the speech signal received on line 44 that permits accurate and natural sounding playback or reconstruction of the analog speech signal 44. For each of the phonemes sequentially received by analyzer 48 over line 46, digital data encoder 68 receives the phoneme ID (over line 54), and corresponding prosodic parameter values (i.e., 2.32 KHz, 0.32 ms, 3.3V) identifying the value of the phoneme's prosodic parameters, including the phoneme's pitch (line 62), time duration (line 64) and amplitude (line 66) as measured by detectors 56, 58 and 60. Digital data encoder 68 generates and outputs a data stream on line 72 that includes the encoded speech signal (phoneme IDs and corresponding prosodic parameter values), and can include additional information (voice fonts or voice font IDs, average values for each prosodic parameter of the voice font, ranges, number of quantized levels, and separation between quantized levels, etc.) to assist during speech signal reconstruction. Although not required, the data stream output from encoder 68 can include the designated input voice font and a designated output voice font, or voice font IDs identifying input and output voice fonts. The designated output voice font identifies the voice font which should be used when playing back or reconstructing the original speech signal which was received on line 44. For improved transmission and storage efficiency, voice font IDs should be transmitted (rather than the fonts themselves) when the receiver or addressee of the encoded speech signal has a copy of the designated output voice font, whereas the actual fonts should be used when the addressee does not have copies of the designated output voice fonts. If no fonts or font IDs are transmitted, then a default output voice font can be used.

The data stream output from encoder 68 is transmitted to a remote user or addressee via transmission medium 74. Transmission medium 74 can be, for example, the Internet, telephone lines, or a wireless communications link. Rather than being transmitted, the data output from encoder 68 can be stored on a floppy disk, hard disk drive (HDD), tape drive, optical disk or other storage device to permit later playback or reconstruction of the speech signal.

Figure 5:
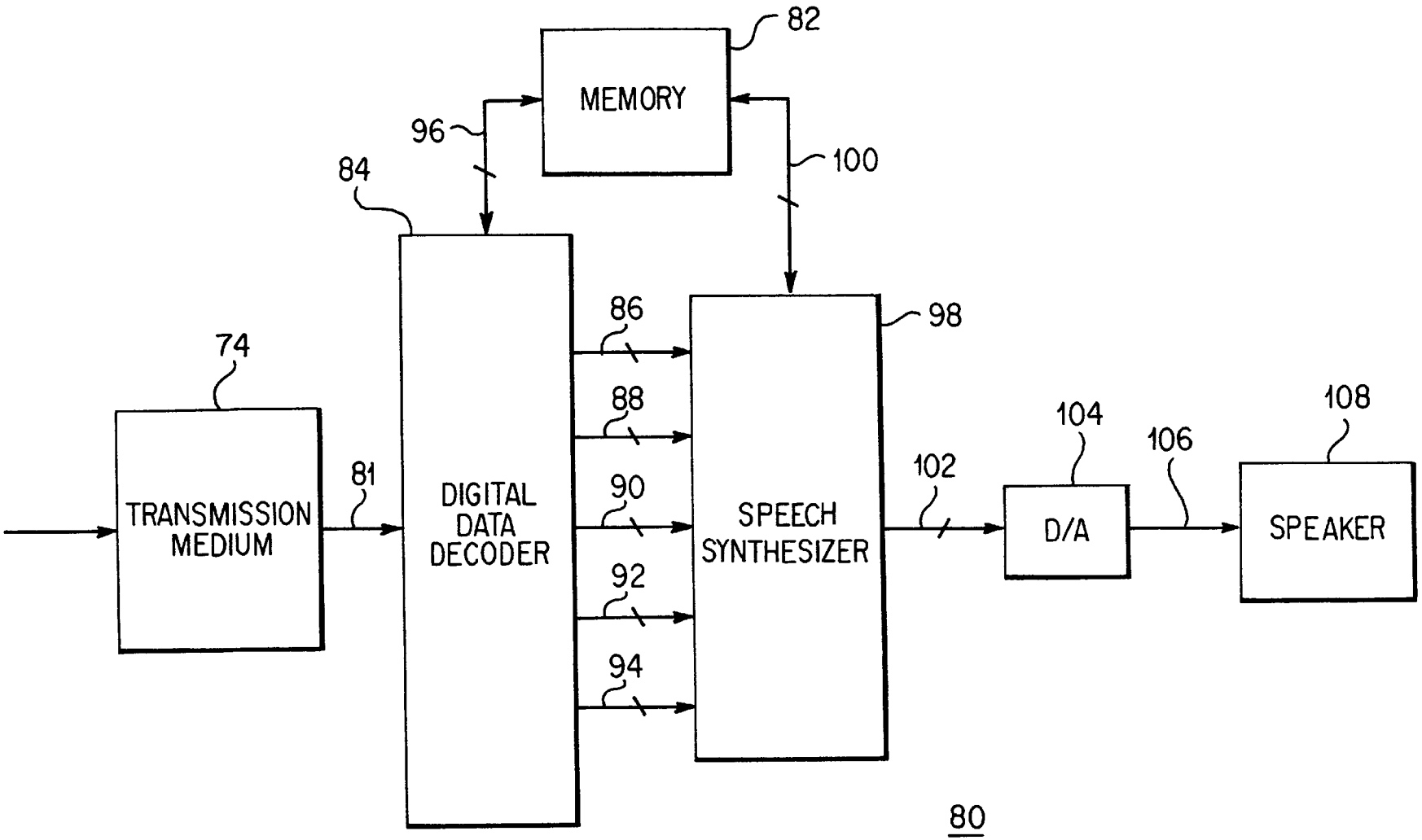
FIG. 5 illustrates a functional block diagram of a speech decoding system according to an embodiment of the present invention.

FIG. 5 illustrates a functional block diagram of a speech decoding system according to an embodiment of the present invention. Speech decoding system 80 includes a memory 82 storing a pattern and a corresponding identification (ID) for each of the 40 phonemes (i.e., a dictionary). As discussed above for system 40, system 80 may alternatively use speech segments other than phonemes. The phoneme IDs for the dictionary stored in memory 82 are the same as the phoneme IDs of the dictionary stored in memory 50 (FIG. 4). Memory 82 also stores one or more voice fonts and their voice font IDs. Memory 82 may store the same voice fonts stored in memory 50 and their associated voice font IDs.

A digital data stream is received over transmission medium 74, which may be for example, the data stream output by encoder 68. The digital data stream is input over line 81 to a digital data decoder 84. Decoder 84 detects the phoneme IDs, corresponding prosodic parameter values and voice fonts or voice font IDs received on the line 81, and other transmitted information. Decoding system 80 implements the dictionary of memory 82 for speech decoding and reconstruction using the phoneme patterns of the designated output voice font. Decoder 84 converts the serial data input on line 81 into a parallel output on lines 86, 88, 90, 92 and 94.

Decoder 84 selects the designated output voice font received on line 81 for use in speech decoding and reconstruction by outputting the corresponding voice font ID on line 86. The voice fonts and information for this voice font (average values, ranges, number of quantized levels, spacing between quantized levels, etc.) received over line 81 are stored in memory 82 via line 96.

For each phoneme ID received by decoder 84 over line 81, decoder 84 outputs the phoneme ID on line 88 and simultaneously outputs the corresponding prosodic parameter values received on lines 81, including the phoneme pitch on line 90 (i.e., 1 KHz), the phoneme duration on line 92 (i.e., 0.35 ms) and the phoneme amplitude on line 94 (i.e., 3.2 V). Lines 86–94 can each carry multi bit signals.

Speech synthesizer 98 receives the phoneme IDs over line 88, corresponding prosodic parameter values over lines 90, 92 and 94, and voice font IDs for the speech sample over line 86. Synthesizer 98 has access to the voice fonts and corresponding phoneme IDs stored in memory 82 via line 100, and selects the voice font (i.e., phoneme patterns) corresponding to the designated output voice font to use as a dictionary for speech reconstruction. Synthesizer 98 generates an accurate and natural sounding speech signal by concatenating voice font phonemes of the designated output voice font in the same order in which phoneme IDs are received by decoder 84 over line 81. The concatenation of voice font phonemes corresponding to the received phoneme IDs generates a digitized speech signal that accurately reflects what was said (same phonemes) in the original speech signal (on line 44). To generate a natural sounding speech signal that also reflects how the original speech signal was said (i.e., with the same varying pitch, duration, amplitude), however, each of the concatenated phonemes output by synthesizer 98 must first be modified according to each phoneme's prosodic parameter values received on line 81. For each phoneme ID received on signal 81 (and provided on signal 88), synthesizer 98 identifies the corresponding phoneme stored in the designated output voice font (identified on signal 86). Next, synthesizer 98 adjusts or modifies the relative pitch of the corresponding voice font phoneme according to the pitch value provided on signal 90. Different voice fonts can have different spacings between quantized levels, and different average pitches (frequencies). As an example, if the pitch value on signal 90 is 128 (indicating the average pitch), then no pitch adjustment occurs, even though the exact pitch of the output voice font phoneme having value 128 (indicating average pitch) may be different. If, for example, the pitch value provided on signal 90 is 130, this indicates that the output phoneme should have a pitch value that is two quantized levels higher than the average pitch for the designated output voice font. Therefore, the pitch for this output phoneme would be increased by two quantized levels.

In a similar fashion as that described for the phoneme pitch value, the duration and amplitude are adjusted based on the values of the phoneme's duration and amplitude received on signals 92 and 94, respectively.

As with the adjustment of the output phoneme's pitch, the duration and amplitude of the output phoneme will be increased or decreased by synthesizer 98 in quantized steps as indicated by the values provided on signals 92 and 94. After the corresponding voice font phoneme has been modified according to the prosodic parameter values received on signals 90, 92 and 94, the output phoneme is stored in a memory (not shown). This process of identifying the received phoneme ID, selecting the corresponding output phoneme from the designated output voice font, modifying the output phoneme, and storing the modified output phoneme, is repeated for each phoneme ID received over line 81. A smoothing algorithm may be performed on the modified output phonemes to smooth together the phonemes.

The modified output phonemes are output from synthesizer 98 on line 102. D/A converter 104 converts the digitized speech signal received on line 102 to an analog speech signal, output on line 106. Analog speech signal on line 106 is input to speaker 108 for output as audio which can be heard.

In order to reconstruct all aspects of the original speech signal (received by system 40 at line 44) at decoding system 80, the designated output voice font used by system 80 during reconstruction should be the same as the designated input voice font, which was used during encoding at system 40. By selecting the output voice font to be the same as the input voice font, the reconstructed speech signal will include the same phonemes (what was said), having the same pitch, duration and amplitude, and also having the same unique voice qualities (harsh, rough, smooth, throaty, nasal, specific voice frequency, etc.) as the original input voice (on line 44).

However, a designated output voice font may be selected that is different from the designated input voice font. In this case, the reconstructed speech signal will have the same phonemes and the pitch, duration and amplitude of the phonemes will vary in a proportional amount or similar manner as in the original speech signal (i.e., similar or proportional varying pitches, intonation, rhythm), but will have unique voice qualities that are different from the input voice. For example, the input voice (on line 44) may be a woman's voice (high pitched and smooth), and the output voice font may be a man's voice (low pitch, rough, wider frequency range, wider range of amplitudes, durations, etc.).

Figure 6:
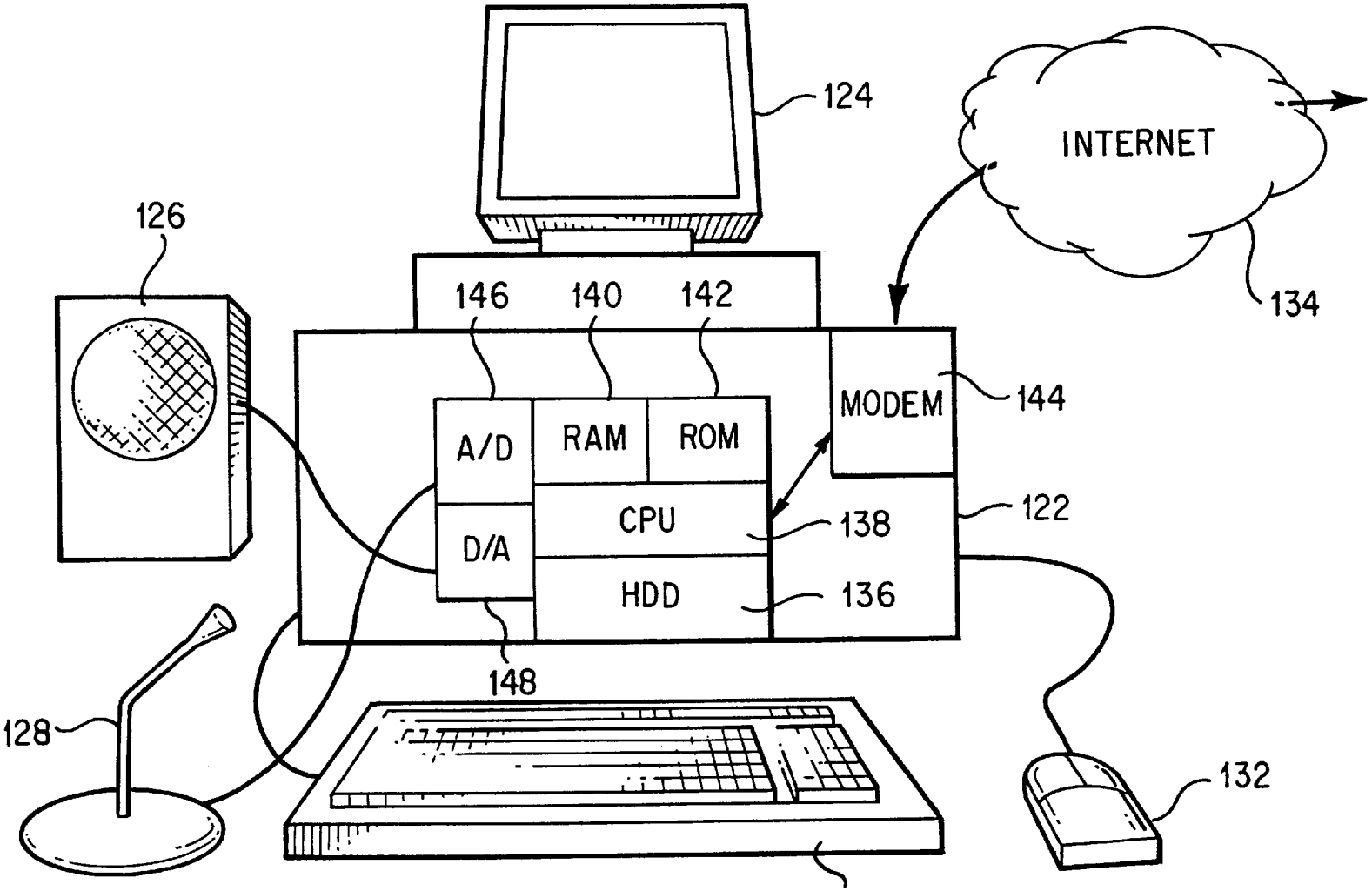
FIG. 6 illustrates a block diagram of an embodiment of a computer for implementing the speech encoding system of FIG. 4 and speech decoding system of FIG. 5.

FIG. 6 illustrates a block diagram of an embodiment of a computer system for implementing speech encoding system 40 and speech decoding system 80 of the present invention. Personal computer system 120 includes a computer chassis 122 housing the internal processing and storage components, including a hard disk drive (HDD) 136 for storing software and other information, a CPU 138 coupled to HDD 136, such as a Pentium® processor manufactured by Intel Corporation, for executing software and controlling overall operation of computer system 120. A random access memory (RAM) 140, a read only memory (ROM) 142, an A/D converter 146 and a D/A converter 148 are also coupled to CPU 138. Computer system 120 also includes several additional components coupled to CPU 138, including a monitor 124 for displaying text and graphics, a speaker 126 for outputting audio, a microphone 128 for inputting speech or other audio, a keyboard 130 and a mouse 132. Computer system 120 also includes a modem 144 for communicating with one or more other computers via the Internet 134.

HDD 136 stores an operating system, such as Windows 95®, manufactured by Microsoft Corporation and one or more application programs. The phoneme dictionaries, fonts and other information (stored in memories 50 and 82) can be stored on HDD 136. By way of example, the functions of speech analyzer 48, detectors 56, 58 and 60, digital data encoder 68, decoder 84, and speech synthesizer 98 can be implemented through dedicated hardware (not shown), through one or more software modules of an application program stored on HDD 136 and written in the C++ or other language and executed by CPU 138, or a combination of software and dedicated hardware.

Referring to FIGS. 4–6, the operation of encoding system 40 and decoding system 80 will now be explained by way of example. Lisa Smith, located in Seattle, Wash. and her friend Mark Jones, located in New York, N.Y., are both Arnold Schwarzenegger fans. Lisa and Mark each has a personal computer system 120 that includes both speech encoding system 40 and speech decoding system 80. Lisa's and Mark's computers are both connected to the Internet and they frequently communicate over the Internet using E-mail and an Internet telephone.

Lisa creates a computerized birthday card for Mark. The birthday card includes personalized text, graphics and speech. After creating the text and graphics portion of the card using a commercially available software package, Lisa reads a standard sentence into her computer's microphone. The received speech signal of the sentence is digitized and stored in memory. The standard sentence includes all 40 American English phonemes. Based on this sentence, Lisa's encoding system 40 generates Lisa's voice font, including the digitized phonemes, calculated values for average pitch, duration, amplitude, ranges, and spacings between each quantized level, and stores Lisa's voice font and calculated values in memory 50. Lisa uses mouse 132 to select her voice font as the designated input voice font for all speech signals for this card.

Lisa then reads in a first sentence (a first speech signal) into her microphone wishing her friend Mark a happy birthday. Lisa uses her mouse 132 to select her voice font as the designated output voice font for this first speech signal. Lisa then reads a second sentence into her microphone wishing Mark a happy birthday from Arnold Schwarzenegger. Lisa uses her mouse 132 to select the Schwarzenegger voice font as the designated output voice font for this second speech signal of the card. The first and second speech signals input by Lisa are digitized and stored in memory 82.

Lisa's speech analyzer 48 uses pattern recognition to identify all the phonemes contained in the first and second speech signals. The phonemes (or patterns) of each of the received first and second speech signals are separately output over line 52 for further processing. Based on the dictionary (using her voice font) stored in memory 50 of Lisa's computer system 120, the phoneme ID for each phoneme in her first and second speech signals are sequentially output over line 54 to encoder 68. Detectors 56, 58 and 60 detect the pitch, duration and amplitude of each received phoneme, and output values on lines 62, 64 and 66 identifying the values of the detected prosodic parameters for each received phoneme.

For each phoneme received on line 52, digital data encoder 68 compares the prosodic parameter values received on lines 62 (pitch), 64 (duration) and 66 (amplitude) to each of the average values for pitch, duration and amplitude of the corresponding phonemes in Lisa's voice font. Encoder 68 outputs a data stream 72 that includes the phoneme's ID, relative pitch, relative time duration and relative amplitude (as compared to Lisa's average values) for each of the phonemes received by speech analyzer 48. The data stream output by encoder 68 also includes information identifying Lisa's voice font as the designated output voice font for the first speech segment, and Schwarzenegger's voice font for the second speech segment. The data stream also includes a copy of Lisa's voice font and the calculated values for her voice font because Mark has a copy of Schwarzenegger's voice font but does not have a copy of Lisa's voice font. The transmission of a voice font and calculated values increases the system bandwidth requirements.

The data stream output by encoder 68 is merged into a file with the text and graphics to complete Mark's birthday card. The file is then E-mailed to Mark over the Internet (medium 74). After Mark receives and clicks on the card, Marks computer system 120 processes and outputs to his monitor 124 the text and graphics portions of the card in a conventional fashion.

Decoder 84 in Mark's computer receives the data stream output from encoder 68. Decoder 84 in Mark's computer detects the phoneme IDs, corresponding prosodic parameter values and voice font IDs and other information received on the signal 81. Lisa's voice font and calculated values are stored in memory 82 of Mark's computer system. During processing of the first speech segment, decoder 84 outputs the voice font ID for Lisa's voice font onto line 86. During processing of the second speech segment, decoder 84 outputs the ID of Schwarzenegger's voice font onto line 86. For each phoneme ID received on signal 81, decoder 84 outputs the phoneme ID on signal 88 and the received values for the phoneme's prosodic parameters over signals 90, 92 and 94.

For each phoneme ID received on signal 88 in Mark's computer, synthesizer 98 in Mark's computer identifies the corresponding phoneme stored in the designated (Lisa's or Schwarzenegger's) output voice font (identified by signal 86). Lisa's voice font is used for the first segment and Schwarzenegger's voice font is used for the second segment. Next, synthesizer 98 modifies the relative pitch, duration and amplitude of the corresponding voice font phoneme according to the values provided on signals 90, 92 and 94, respectively. The modified output phonemes for the first and second segments are then smoothed and output as a digitized speech signal, converted to an analog form, and input to speaker 108 of Mark's computer for Mark to hear. In this manner, Mark hears the first happy birthday speech segment input by Lisa at her computer, including what Lisa said (same phonemes), how she said it (same varying pitch, duration, amplitude, rhythm, intonation, etc.), and with an output voice that has the same qualities (high pitch, smooth, etc.) as Lisa's.

Mark also hears the second speech segment including what Lisa said (same phonemes) and includes similar or proportional variations in pitch, duration, rhythm, amplitude or stress as the original segment input by Lisa. However, because the second speech segment is generated at Mark's computer using Schwarzenegger's voice font rather than Lisa's, the second speech segment heard by Mark is in Schwarzenegger's voice, which is deeper, has increased frequency and amplitude ranges, and other unique voice qualities that distinguish Schwarzenegger's voice from Lisa's.

In a similar manner, Lisa can communicate with Mark using an Internet phone that uses encoding system 40 to encode and send speech signals in real-time over the Internet, and decoding system 80 to receive, decode and output speech signals in real-time. Using her Internet phone, Lisa selects Schwarzenegger's voice font as the designated output voice font (unknown to Mark), and speaks into her microphone 128, in attempt to spoof Mark by pretending to be Arnold Schwarzenegger. Her speech signals are encoded and transmitted over the internet in real-time to Mark. Marks's computer receives, decodes and outputs her speech signals, which sound like Schwarzenegger.

The above describes particular embodiments of the present invention as defined in the claims set forth below. The invention embraces all alternatives, modifications and variations that fall within the letter and spirit of the claims, as well as all equivalents of the claimed subject matter. For example, while each of the prosodic parameters have been represented using eight bit words, the parameters may be represented by words having more or less bits.

What is claimed is:

1. A method of communicating speech signals comprising the steps of:

storing at a first location a plurality of input voice fonts, each input voice font comprising information describing a plurality of speech segments, each speech segment identified by a segment ID;

selecting one of the plurality of input voice fonts;

designating one of a plurality of voice fonts to be used as an output voice font;

receiving an analog speech signal, said analog speech signal comprising a plurality of speech segments;

digitizing the analog speech signal;

identifying each of the plurality of speech segments in the received speech signal;

measuring one or more prosodic parameters for each of said identified segments in relation to the segments of the selected input voice font; and transmitting a data signal from the first location to a second location, said data signal comprising segment IDs, values of the measured prosodic parameters of the speech segments in the received speech signal, and an output voice font ID identifying the designated output voice font;

storing at the second location a plurality of output voice fonts, each output voice font comprising information describing a plurality of speech segments, each speech segment identified by a segment ID;

receiving the transmitted data signal at the second location;

identifying in said received data signal the segment IDs, the values of the measured prosodic parameters, and the designated output voice font corresponding to the received output voice font ID;

selecting, in the designated output voice font, the information describing a plurality of speech segments corresponding to the received segment IDs;

modifying the selected speech segment information according to the received values of the corresponding prosodic parameters; and generating a speech signal based on the modified speech segment information.

2. The method of claim 1 wherein the output voice font is the same as the input voice font.

3. The method of claim 1 wherein the output voice font is different from the input voice font.

4. The method of claim 1 wherein said step of measuring one or more prosodic parameters for each of said segments comprises the steps of:

measuring the pitch for each of said segments;

measuring the duration for each of said segments; and measuring the amplitude for each of said segments.

5. The method of claim 1 wherein said step of receiving an analog speech signal comprises the step of receiving an analog speech signal, said analog speech signal comprising a plurality of phonemes.

6. An apparatus for encoding speech signals comprising:

a memory storing a plurality of voice fonts, each said voice font comprising a digitized pattern for each of a plurality of speech segments, each speech segment identified by a segment ID;

an A/D converter adapted to receive an analog speech signal and having an output;

a speech analyzer coupled to said memory and said A/D converter, said speech analyzer adapted to receive a digitized speech signal and identify each of the segments in the digitized speech signal based on a selected one of said voice fonts, said speech analyzer adapted to output the segment ID for each of said identified speech segments;

one or more prosodic parameter detectors coupled to said memory and said speech analyzer, said detectors adapted to measure values of the prosodic parameters of each received digitized speech segment; and a data encoder coupled to said speech analyzer and adapted to generate a digital data signal for transmission or storage, said digital data signal comprising a segment ID and the measured values of the corresponding measured prosodic parameters for each of the identified speech segments and a voice font ID identifying one of a plurality of output voice fonts for use in regenerating the speech signal.

7. A computer for encoding speech signals comprising:

a CPU;

an audio input device adapted to receive an analog audio or speech signal and having an output;

an A/D converter having an input coupled to the output of said audio input device and an output coupled to said CPU;

a memory coupled to said CPU, said memory storing software and a plurality of voice fonts, each voice font comprising a digitized pattern and a corresponding segment ID for each of a plurality of speech segments; and said CPU being adapted to:

identify, using a selected one of said voice fonts as an input voice font, each of a plurality of speech segments in a received digitized speech signal;

measure one or more prosodic parameters for each of the identified segments; and generate a data signal comprising segment IDs and values of the measured prosodic parameters of each of the identified speech segments and a voice font ID designating one of a plurality of voice fonts to be used as an output voice font for use in regenerating the speech signal.

8. The computer of claim 7 wherein said audio input device comprises a microphone.

9. An apparatus for decoding speech signals comprising:

a memory storing a plurality of output voice fonts, each output voice font comprising a digitized pattern for each of a plurality of speech segments, each speech segment identified by a segment ID;

a data decoder coupled to said memory and receiving a digital data stream from a transmission medium, said decoder identifying in the received data stream a voice font ID designating one of a plurality of voice fonts to be used as an output voice font, a segment ID and values of one or more corresponding prosodic parameters for each of the plurality of speech segments in the received data stream;

a speech synthesizer coupled to said memory and said decoder, said synthesizer selecting digitized patterns in the designated output voice font corresponding to the identified segment IDs, modifying the selected digitized patterns according to the values of the corresponding prosodic parameters, and outputting the modified speech patterns to generate a speech signal.

10. A method of speech encoding comprising the steps of:

selecting one of a plurality of voice fonts to be used as an input voice font;

designating one of a plurality of voice fonts to be used as an output voice font, said output voice font being different from said input voice font;

receiving an analog speech signal, said analog speech signal comprising a plurality of speech segments;

digitizing the analog speech signal;

identifying each of the plurality of speech segments in the received speech signal;

measuring one or more prosodic parameters for each of said identified segments in relation to segments of the selected input voice font;

outputting a data signal comprising a voice font ID identifying the designated output voice font, segment IDs and values of the measured prosodic parameters of the speech segments in the received speech signal;

receiving the data signal; and generating a speech signal using the designated output voice font based on the segment IDs and the values of the measured prosodic parameters in the data signal.

* * * * *